US006116892A

United States Patent [19]

Yang

[11] Patent Number: 6,116,892

[45] Date of Patent: Sep. 12, 2000

[54] SAFETY FLINT-TYPE LIGHTER

[76] Inventor: John Jiin Chung Yang, 15443 Proctor Ave., Suite B, Industry, Calif. 91745

[21] Appl. No.: 09/383,864

[22] Filed: Aug. 26, 1999

[30] Foreign Application Priority Data

Aug. 28, 1998 [CN] China ..... 98 2 27709

[51] Int. Cl.[7] ..... F23D 11/36; F23Q 1/02

[52] U.S. Cl. ..... 431/153; 431/154; 431/277; 431/344

[58] Field of Search ..... 431/153, 154, 431/137, 133, 344, 259, 273, 274, 275, 276, 277

[56] References Cited

U.S. PATENT DOCUMENTS

| | | | |
|---|---|---|---|
| 1,091,891 | 3/1914 | Pasierbski | 431/274 |
| 1,436,635 | 11/1922 | Aronson | 431/275 |
| 3,827,852 | 8/1974 | Chevallier | 431/254 |
| 5,120,216 | 6/1992 | Iwahori | 431/254 |
| 5,197,870 | 3/1993 | Yang | 431/276 |
| 5,358,401 | 10/1994 | Iwahori et al. | 431/254 |
| 5,468,144 | 11/1995 | Iwahori | 431/254 |

FOREIGN PATENT DOCUMENTS

| | | | |
|---|---|---|---|
| 440908 | 7/1912 | France | 431/274 |
| 238040 | 3/1910 | Germany | 431/125 |
| 362236 | 10/1922 | Germany | 431/273 |
| 712926 | 10/1941 | Germany | 431/125 |
| 132700 | 8/1951 | Sweden | 431/125 |
| 138395 | 2/1920 | United Kingdom | 431/274 |
| 543631 | 3/1942 | United Kingdom | 431/273 |

*Primary Examiner*—Ira S. Lazarus
*Assistant Examiner*—David Lee
*Attorney, Agent, or Firm*—Raymond Y. Chan; David and Raymond

[57] ABSTRACT

A safety flint type lighter includes a striker blade having a striking surface which is in contact with the flint slidably mounting on a blade-track provided on the inner side of the supporting walls and a resilient element normally retaining and urging itself vertically and driving the striking surface of the striker blade to rapidly slide on the flint for striking spark. A locking latch is downwardly protruded from the top end of said pusher button facing said gas emitting nozzle. Operating the lighter, the pusher button is depressed and pulled outward wherein the depressed locking latch griping the resilient element and bending the resilient element. The resilient element is released at a point and driven the striker blade on the flint for generating spark.

16 Claims, 5 Drawing Sheets

SAFETY FLINT-TYPE LIGHTER

BACKGROUND OF THE PRESENT INVENTION

1. Field of Invention

The present invention relates to a flint type lighter, and more particularly to a safety flint type lighter wherein the lighter is practically impossible to be ignited accidentally or ignited by children.

2. Description of Related Arts

Modern butane lighters have become very popular, especially the flint type lighters, since the lighter are economy and cheap, easy operation, and easy to fight the fire.

However, the conventional flint type lighters have drawbacks in their usage. During the ignition of a conventional flint type lighter, the spark wheel must by rotated in order to strike a spark and then the pusher button is depressed for releasing gas. When the quality of the flint is poor, the spark generated may not strong enough for ignition. Moreover, the action of rotating the spark wheel and depressing the pusher button is not in one continuous motion and leads to different operational results depending on the users. Thus, the spark wheel gives friction to the flint in order to strike a spark, the residue of the flint will remain on the spark wheel of the lighter. During rotating the spark wheel, the residue of the flint may stick on an adult's thumb. In worse circumstance, user may repeat to rotate the spark wheel when failure ignition, the user's thumb may feel painful and dirty his or her thumb as well. So, the conventional flint type lighters are cheap and in usual shape and still have their drawbacks, and thus it is desirable that the lighter be improved for practical use.

Nowadays, a piezoelectric lighter is getting more popular wherein the piezoelectric lighter comprising a piezoelectric unit for generating piezoelectricity. User will only depress the pusher button in order to ignite the lighter. However, the piezoelectric unit is widely used in a high class lighter but is not widely used in a disposable lighter because the cost of the piezoelectric unit is too high to install in a disposable lighter. The use of the piezoelectric lighter is still restricted in certain circumstances.

Furthermore, it is now required a safety device preventing under age children from the usage of the lighter. The present invention provides not only a safety device avoiding the lighter to be ignited accidentally but also a solution to solve the drawbacks set forth above.

SUMMARY OF THE PRESENT INVENTION

The main object of the present invention is to provide a safety flint type lighter for preventing under age children from the usage of the lighter.

Another object of the present invention is to provide a safety flint type lighter wherein the ignition of the lighter of the present invention requires simple single-action operation by an adult's thumb.

Another object of the present invention is to provide a safety flint type lighter wherein the safety device is adapted to be installed to all kind of flint type lighter.

Another object of the present invention is to provide a safety flint type lighter wherein no residue of the flint will stick on an adult's thumb after the ignition.

Another object of the present invention is to provide a safety flint type lighter wherein the safety device does not require to alter the original structure design of the flint type lighter, so as to minimize the manufacturing cost of incorporating the safety device with every conventional flint type lighter having a pusher button.

Another object of the present invention is to provide a safety flint type lighter wherein the flint type lighter of the present invention can keep the beauty shape of the lighter.

Accordingly, in order to accomplish the above objects, the present invention provides a flint type lighter which comprises a supporting frame, an ignition means, and a safety device. The supporting frame comprises a casing having a liquefied gas cavity. A pair of supporting walls protruded on opposite sides of a ceiling and each of the supporting walls has a circular gas-level holes provided thereon for pivotally mounting a gas level between the two supporting walls. A gas emitting nozzle is appeared from the ceiling of the casing and communicated with the liquefied gas cavity which is actuated by the gas level for releasing gas therefrom. A flame regulator is encircled the gas emitting nozzle and controlled the flow of gas through the gas emitting nozzle. A windshield is mounted on the ceiling of the casing for encircling the gas emitting nozzle.

The ignition means comprises a flint supported by a flint-spring and a striker blade which is slidably mounted on the supporting walls. The striker blade has a striking surface which is in contact with the flint. The flint is retained urging against the striking surface of the striker blade by means of the flint-spring for generating sparks directed toward the gas emitting nozzle when the striking surface is driven to slide against the flint. A resilient element is connected to the striker blade on opposite side of the gas emitting nozzle wherein the lower end of the resilient element affixing on the ceiling of the casing.

The safety device comprises a pusher button disposed on the ceiling of the casing in vertically and outwardly movable manner wherein the pusher button comprising an axle protruded from each outer side thereof which are adapted for inserting into a supporting slot mounted on each inner side of the supporting walls, and a locking latch downwardly protruded from the top end thereof facing the gas emitting nozzle. A safety groove mounted on each of the supporting walls and a safety slot mounted therein.

In order to ignite the lighter, the pusher button must be depressed until the locking latch of the pusher button grip to the top end of the resilient element and then the pusher button is able to be pull outwardly. At the mean time, the locking latch will pull the resilient element outwardly and the striker blade as well. After a predetermined radial movement of the pusher button, the resilient element will be released automatically as a trigger and returned to its original position. So, a spark will be generated through mutual friction between the striker blade and the flint. When the depressing force applied on the pusher button is released, a pusher spring under the pusher button will push the pusher button upward to its upper normal position.

DETAILED DESCRIPTION OF THE PREFERRED EMBODIMENT

Figure 1:
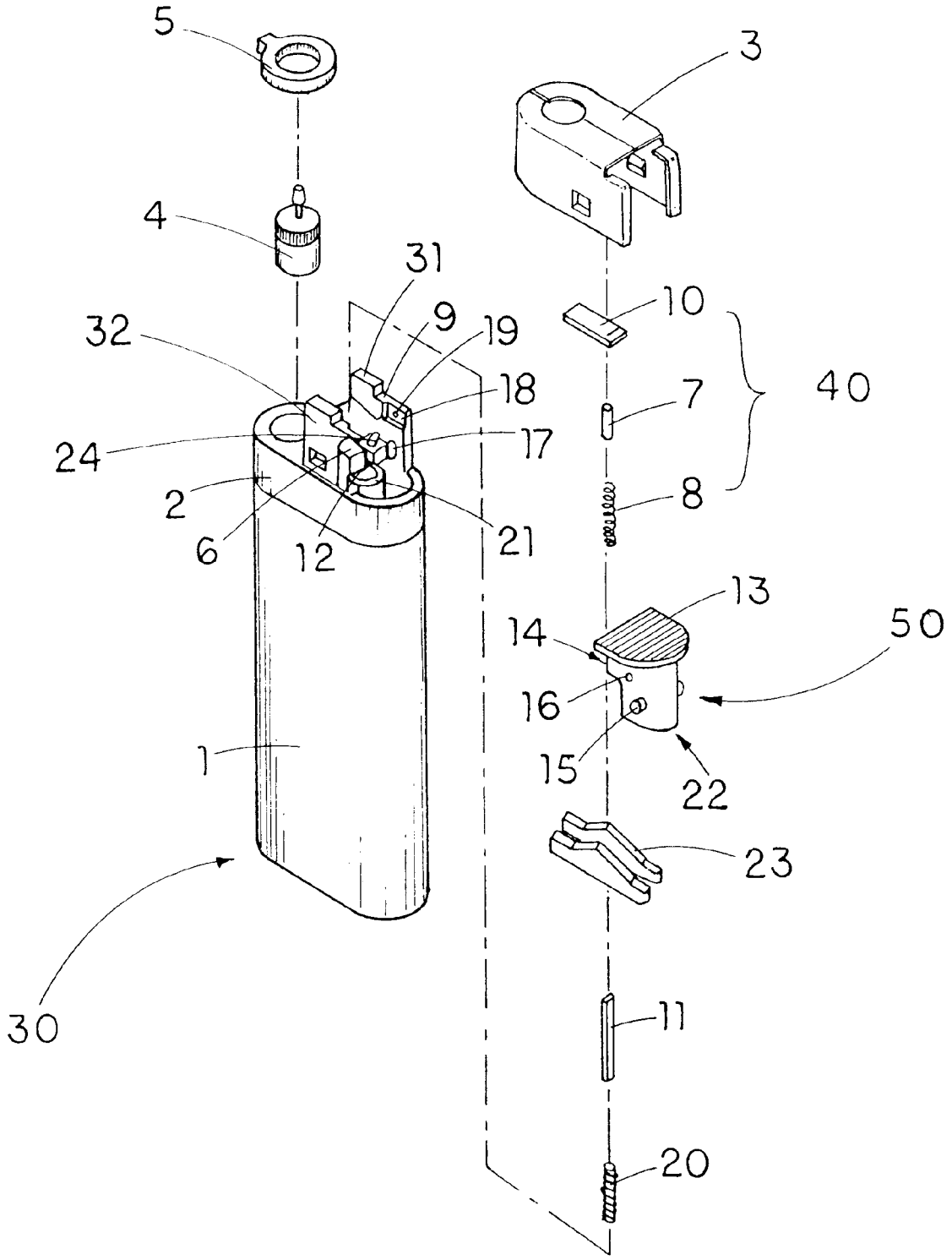
FIG. 1 is an exploded perspective view of a safety flint type lighter according to a preferred embodiment of the present invention.

Referring to FIG. 1 of the drawing, a safety flint type lighter is illustrated according to a preferred embodiment. A flint type lighter comprises a supporting frame 30, an ignition means 40, and a safety device 50. The supporting frame 30 comprises a casing 1 having a liquefied gas cavity. A pair of supporting walls 31, 32 protruded on opposite sides of a ceiling 2 and each of the supporting walls 31, 32 has a circular gas-level holes 17 provided thereon for pivotally mounting a gas level 23 between the two supporting walls 31, 32. A gas emitting nozzle 4 is appeared from the ceiling 2 of the casing 1 and communicated with the liquefied gas cavity which is actuated by the gas level 23 for releasing gas therefrom. A flame regulator 5 is encircled the gas emitting nozzle 4 and controlled the flow of gas through the gas emitting nozzle 4. A windshield 3 is mounted on the ceiling 2 of the casing 1 for encircling the gas emitting nozzle 4.

The safety flint type lighter further comprises an ignition means, which comprises a flint 7, a striker blade 10, and a resilient element 11, and a safety device, which comprises a pusher button, a safety groove, and a pusher spring 20.

The flint 7 supported by a flint-spring 8 wherein the flint 7 and the flint-spring 8 being received in a flint housing 6 provided on the ceiling 2 of the casing 1 between the two supporting walls 31, 32.

The striker blade 10 having a striking surface which is in contact with the flint 7 is slidably mounted on a blade-track 9 provided on the inner side of the supporting walls 31, 32. The flint 7 is retained urging against the striking surface of the striker blade 10 by means of the flint-spring 8 for generating sparks directed toward the gas emitting nozzle 4 when the striking surface is driven to slide against the flint 7.

The resilient element 11, which is an elastic metal blade, is connected to the striker blade 10 on the oppsite side of the gas emitting 4 wherein the bottom end of the resilient element 11 affixing on the resilient element housing 12 mounted on the ceiling 2 of the casing 1. Accordingly, the resilient element 11 will normally retain and urge itself vertically, wherein the resilient element 11 acts as a trigger forcing the striking surface of the striker blade 10 rapidly slided on the flint 7 for striking spark.

The pusher button 13, having an axle 15 outwardly protruded from the lower portion of two outer sides thereof which are adapted for inserting into a supporting slot 17 mounted on each inner side of the supporting walls 31, 32, is disposed on the ceiling 2 of the casing 1 in vertically and outwardly movable manner. An engaging bolt 16 outwardly protruding from two outer sides of the pusher button 13 will bias against the safety groove 18 when the pusher button is depressed. The pusher spring 20 will normally retain and urge the pusher button 13 in the upper normal position wherein one end of the pusher spring mounting on a spring hole 21 which is affixed on the ceiling 2 of the casing 1 and the other end thereof mounting on a pusher spring holder 22 which is affixed at the bottom of the pusher button 13.

The locking latch 14 downwardly protruded from the top end of the pusher button 13 facing the gas emitting nozzle 4. A safety groove 18, having a predetermined height for the pusher button 13 traveled downward, is mounted on each of the inner side of the supporting walls 31, 32 and a safety slot 19 mounted therein ensure the correct alignment of the pusher button 13 in vertically moveable manner.

Figure 2:
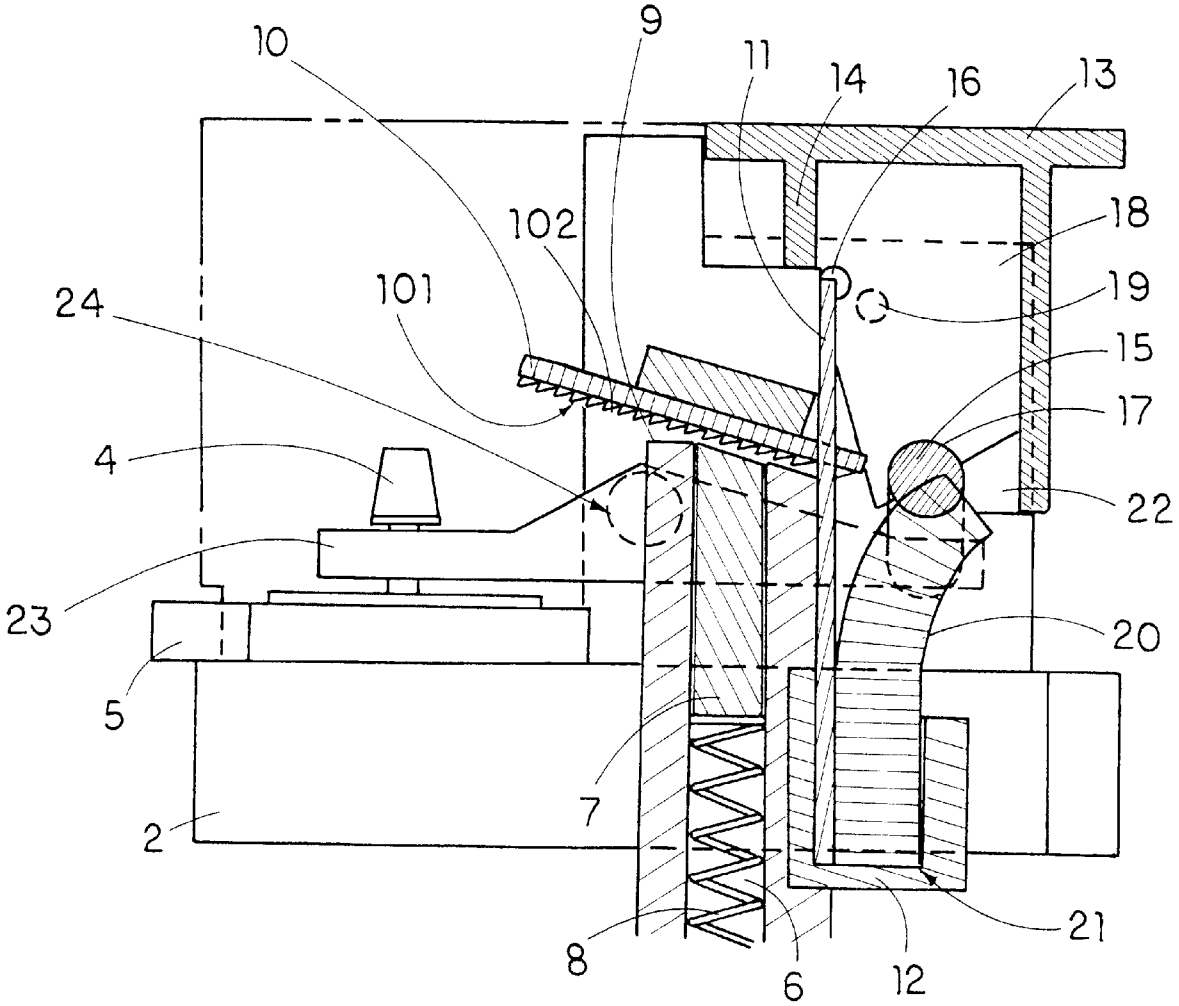
FIG. 2 is a partially sectional view of a safety flint type lighter according to the above preferred embodiment of the present invention, illustrating the pusher button is in normal upper position.

Referring to FIG. 2 of the drawing, the flint type lighter is in normal position. The gas emitting nozzle 4 is in closed condition wherein there is no flow of gas. The resilient element 11 is in contact with the side of the blade-track 9. The axles 15 of the pusher button 13 is retained and urged at the highest point of the supporting slots 17 on the supporting walls 31, 32 by the pusher spring 20. Thus, the engaging bolts 16 are sat on safety grooves 18 in the location of the upper and inner side of the safety slots 19.

Figure 3:
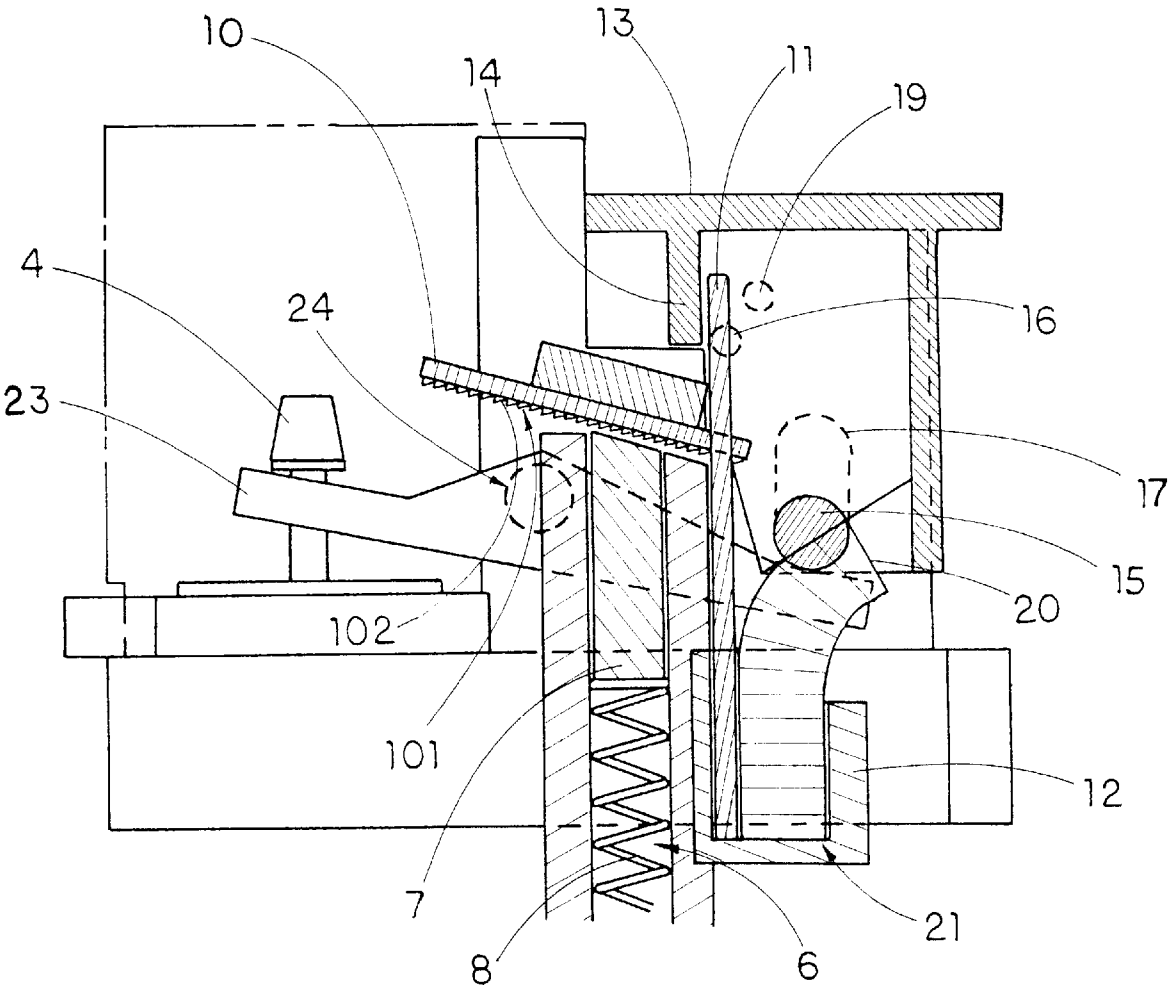
FIG. 3 is a partially sectional view of a safety flint type lighter according to the above preferred embodiment of the present invention, illustrating the lighter is in an engagement position.

In order to ignite the flint type lighter, referring to FIG. 3, the pusher button 13 must be depressed until the engaging bolts 16 on the safety grooves 18 traveled downwardly along the inner side of the safety slots 19 wherein the safety slots 19 ensuring the pusher button 13 in the correct alignment in the vertically movable manner. At the mean time, the axles 15 are slided along the supporting slots 17 from the highest point to the lowest point. One end of the gas lever 23 is pressed by the pusher button 13 for pivotally urge the gas emitting nozzle 4 in order to release gas. The locking latch 14 of the pusher button 13 engages the inner side of upper portion of resilient element 11. Thus, the engaging bolts 16 are now sat on the safety groove in the location of the lower and inner side of the safety slots 19.

Figure 4:
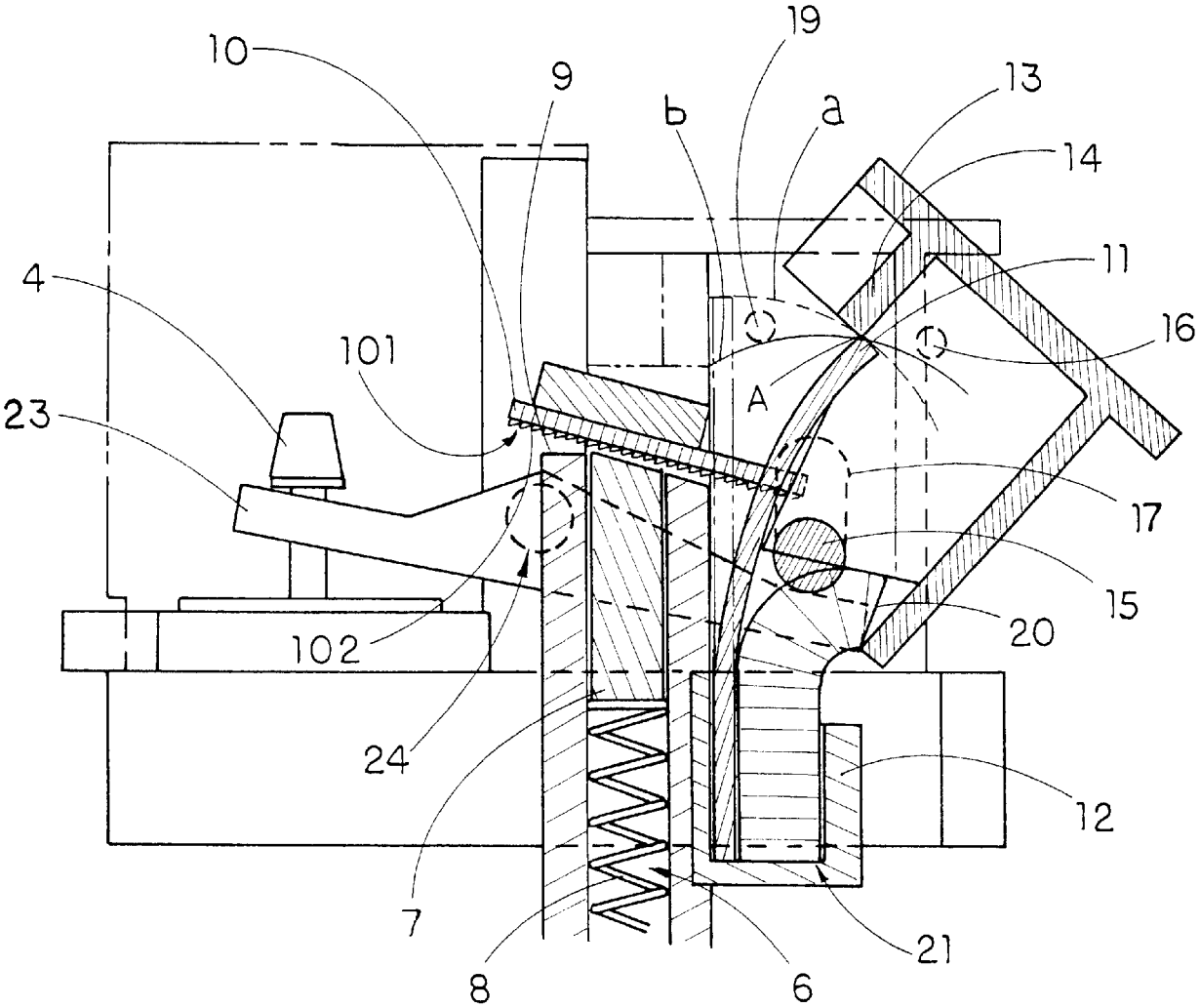
FIG. 4 is a partially sectional view of a safety flint type lighter according to the above preferred embodiment of the present invention, illustrating the lighter is in an ignition position.

Referring to FIG. 4, the depressed pusher button 13 is able to pull radially to the axles 15 and will grip the upper portion of the resilient element 11 to bend outwardly on opposite side of the gas emitting nozzle 4. At the mean time, the striker blade 10 is slided along the top end of the flint 7 wherein the striking surface having an obtuse angled sharpener in bending direction so as to prevent the striker blade 10 being stuck during mutual friction. Due to the different pathways between the resilient element 11 and the locking latch 14, the resilient element 11 will be released at a certain point of its pathway. Path a, shown in FIG. 4, indicates the pathway of the highest point of the resilient element 11 traveled. Path b indicates the pathway of the lowest point of the locking latch 14. Path a and path b will meet at point A wherein the resilient element 11 is released at point A. When both the resilient element 11 and the locking latch 14 meet at point A, the resilient element 11 will lose the traction force by the locking latch 14 and will rebound to its original position rapidly.

Figure 5:
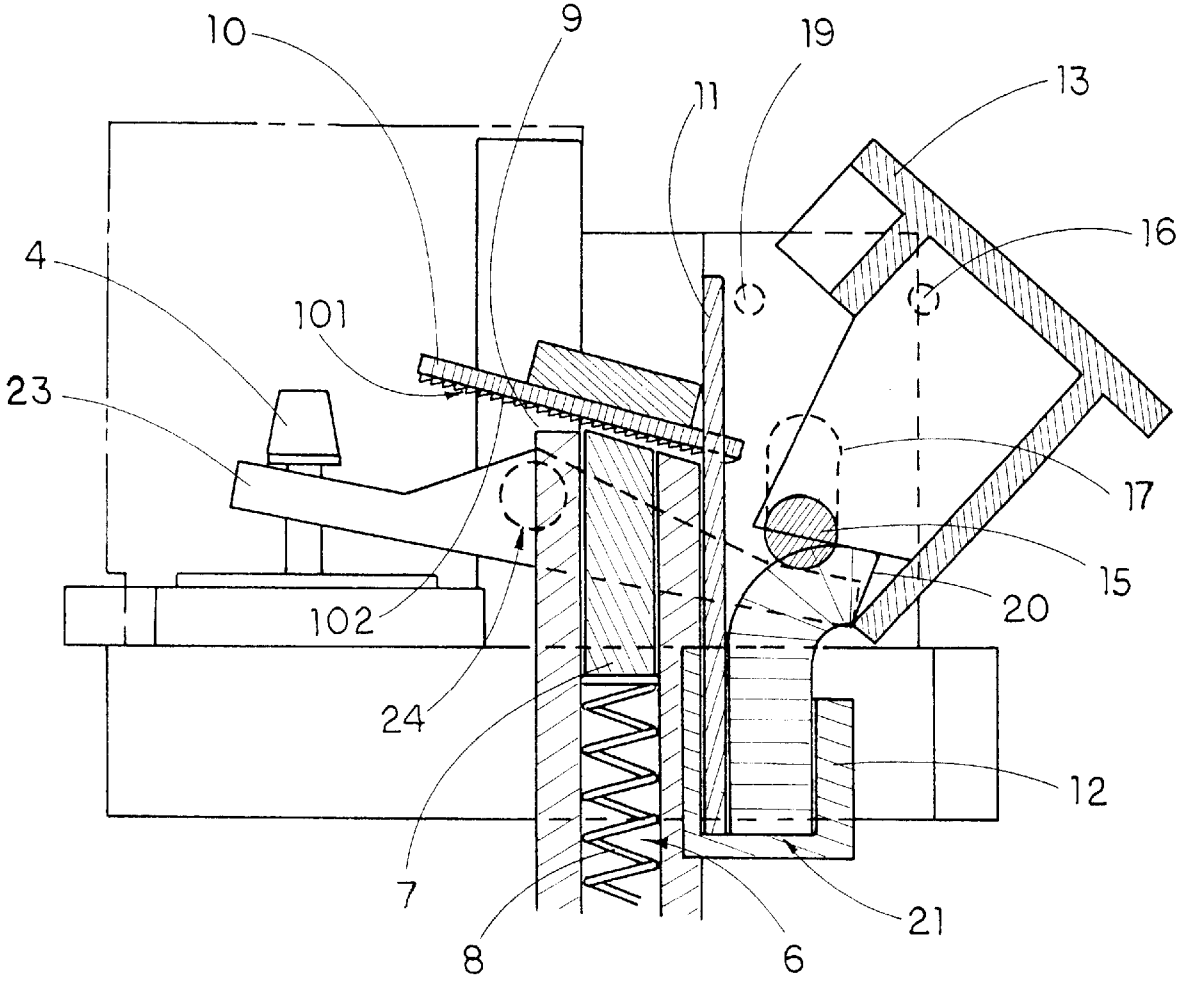
FIG. 5 is a partially sectional view of a safety flint type lighter according to the above preferred embodiment of the present invention, illustrating the pusher button is in a lighting position.

Referring to FIG. 5, the lighter is in the igniting position. When the resilient element 11 is released by the locking latch 14 and will rebound to its original position, the striker blade 10 is pushed by the resilient element 11 and rapidly slided along the blade-track 9 towards the gas emitting nozzle 4. The striking surface on the striker blade 10 having an acute angled sharpener in releasing position is rapidly driven to slide on the flint 7 for striking spark directed toward the gas emitting nozzle 4.

By releasing the depression of the pusher button 13, the compressed pusher spring 20 will rebound to regain its original form that upwardly and inwardly pushes the pusher button 13 returning from the ignition position to its upper normal position instantly. At the mean time, the depressed gas level 23 is released in order to switch off the gas emitting nozzle 4 for releasing gas. All the assembly of the lighter will return to their original position as shown in FIG. 2.

In accordance with the preferred embodiment as disclosed above, the flint type lighter of the present invention can increase the accuracy of the ignition by the ignition means 40 comprising the striker blade 10 and the resilient element 11. User will not touch the ignition means 40 so that no residue of the flint 7 will stick on the user's thumb. Furthermore, no expensive part is added or incorporated and the manufacturing procedure of the present invention is easy so that the cost of the present invention is relatively inexpensive. Moreover, the operation of the present invention is complicated enough for under age children to ignite the lighter. So, the safety flint type lighter of the present invention not only can improve the ignition means of the conventional lighters but also can prevent under age children from the usage of the lighter.

What is claimed is:

1. A safety flint type lighter, comprising a supporting frame comprising a casing having a liquefied gas cavity, a pair of supporting walls upwardly protruding from two opposite sides of a ceiling and each of said supporting walls having a circular gas-lever hole provided thereon for pivotally mounting a gas lever between said two supporting walls, a gas emitting nozzle appearing from said ceiling of said casing and communicating with said liquefied gas cavity which is actuated by said gas lever for releasing gas therefrom, a flame regulator encircling said gas emitting nozzle and controlling the flow of gas through said gas emitting nozzle, and a windshield mounting on said ceiling of said casing for encircling said gas emitting nozzle;

an ignition means comprising a flint supporting by a flint-spring wherein said flint and said flint-spring are received in a flint housing provided on said ceiling of said casing between said two supporting walls, a striker blade having a striking surface which is in contact with said flint slidably mounting on a blade-track provided on inner sides of said supporting walls, said flint retained urging against said striking surface of said striker blade by means of said flint-spring for generating sparks directed toward said gas emitting nozzle when said striking surface is driven to slide against said flint, and a resilient element connecting to said striker blade on opposite side of said gas emitting nozzle wherein a lower end of said resilient element is affixed in a resilient element housing mounted on said ceiling of said casing; and a safety device comprising:

a pusher button having an axle having two ends outwardly protruded from lower portions of two outer sides of said pusher button, wherein said two ends of said axle are adapted for inserting into two supporting slots provided on inner sides of said two supporting walls respectively so as to dispose on said ceiling of said casing in a vertically and outwardly movable manner, a pair of trigger protrusions outwardly protruding from two outer sides of said pusher button respectively and biasing against two safety grooves provided on said two inner sides of said two supporting walls respectively when the pusher button is depressed, a pusher spring normally retaining and urging said pusher button in an upper normal position wherein one end of said pusher spring mounting in a spring hole which is provided on said ceiling of said casing while another end thereof is mounted on a pusher spring holder which is provided at a bottom of said pusher button, a locking latch downwardly protruding from a top end of said pusher button facing said gas emitting nozzle, and a pair of safety guiders, each having a predetermined height, inwardly protruded from said two inner sides of said supporting walls respectively in such a manner that each of said two trigger protrusions is normally sat on said respective safety groove in a location of an upper and inner side of said respective safety guider.

2. A safety flint type lighter, as recited in claim 1, wherein said resilient element is an elastic metal blade normally retaining and urging vertically for driving said striking surface of said striker blade to rapidly slide on said flint for striking spark.

3. A safety flint type lighter, as recited in claim 1, wherein a safety slot is provided on each of said safety grooves for ensuring a correct alignment of said pusher button in vertically moveable manner.

4. A safety flint type lighter, as recited in claim 2, wherein a safety slot is provided on each of said safety grooves for ensuring a correct alignment of said pusher button in vertically moveable manner.

5. A safety flint type lighter, as recited in claim 1, wherein said striking surface has a plurality of angled sharpener teeth facing opposite to a bending direction of said resilient element so that there is insignificant friction to generate spark in order to prevent said striker blade being stuck during mutual friction, wherein when said resilient element is released, said striking surface having said angled sharpener teeth thereon rapidly is rapidly driven to slide on said flint for striking spark in a striking direction toward said gas emitting nozzle.

6. A safety flint type lighter, as recited in claim 2, wherein said striking surface has a plurality of angled sharpener teeth facing opposite to a bending direction of said resilient element so that there is insignificant friction to generate spark in order to prevent said striker blade being stuck during mutual friction, wherein when said resilient element is released, said striking surface having said angled sharpener teeth thereon rapidly is rapidly driven to slide on said flint for striking spark in a striking direction toward said gas emitting nozzle.

7. A safety flint type lighter, as recited in claim 3, wherein said striking surface has a plurality of angled sharpener teeth facing opposite to a bending direction of said resilient element so that there is insignificant friction to generate spark in order to prevent said striker blade being stuck during mutual friction, wherein when said resilient element is released, said striking surface having said angled sharpener teeth thereon rapidly is rapidly driven to slide on said flint for striking spark in a striking direction toward said gas emitting nozzle.

8. A safety flint type lighter, as recited in claim 4, wherein said striking surface has a plurality of angled sharpener teeth facing opposite to a bending direction of said resilient element so that there is insignificant friction to generate spark in order to prevent said striker blade being stuck during mutual friction, wherein when said resilient element is released, said striking surface having said angled sharpener teeth thereon rapidly is rapidly driven to slide on said flint for striking spark in a striking direction toward said gas emitting nozzle.

9. A safety flint type lighter, as recited in claim 1, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

10. A safety flint type lighter, as recited in claim 2, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

11. A safety flint type lighter, as recited in claim 3, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

12. A safety flint type lighter, as recited in claim 4, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

13. A safety flint type lighter, as recited in claim 5, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

14. A safety flint type lighter, as recited in claim 6, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

15. A safety flint type lighter, as recited in claim 7, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

16. A safety flint type lighter, as recited in claim 8, wherein a highest point of said resilient element has a first movement path and a lowest point of the locking latch each has a second movement path, said first and second movement paths meeting at a predetermined point, wherein said resilient element which is bent by said locking latch loses a traction force thereof and rebounds back to a vertical position.

* * * * *